US006141849A

United States Patent [19]

Honsel et al.

[11] Patent Number: 6,141,849

[45] Date of Patent: Nov. 7, 2000

[54] RIVET SETTING DEVICE

[75] Inventors: Michael H. Honsel; Andreas Nolte, both of Froendenberg, Germany

[73] Assignees: M. H. Honsel Beteiligungs GmbH, Germany; Sartam Industries, Inc., Venice, Fla.

[21] Appl. No.: 09/292,877

[22] Filed: Apr. 16, 1999

[30] Foreign Application Priority Data

Apr. 27, 1998 [DE] Germany ..... 198 18 757

[51] Int. Cl.[7] ..... B21J 15/26

[52] U.S. Cl. ..... 29/243.521; 29/243.526; 72/391.4; 72/449; 72/452.5; 72/453.16

[58] Field of Search ..... 72/291.4, 452.5, 72/449, 453.16; 29/243.526, 243.521

[56] References Cited

U.S. PATENT DOCUMENTS 3,127,045 3/1964 Tschantz ..... 72/452.5
3,375,883 4/1968 Schadlich .
3,397,567 8/1968 Klinger ..... 72/452.5
5,136,873 8/1992 Hopkins et al. ..... 72/452.5
5,195,354 3/1993 Yasui et al. ..... 72/452.5
5,473,805 12/1995 Wille ..... 29/243.526
5,553,478 9/1996 Di Troia ..... 72/453.15
5,921,125 7/1999 Inoue et al. ..... 72/452.5

*Primary Examiner*—David Jones
*Attorney, Agent, or Firm*—Majestic, Parsons, Siebert & Hsue

[57] ABSTRACT

The present invention relates to a rivet setting device having an electric drive motor, a rivet setting means in a crank drive for driving the rivet setting means by the drive motor, wherein the crank drive assumes a rest position in one of its dead-center positions and, starting from its rest position, can be rotated by at least one complete rotation for performing a rivet setting operation of the rivet setting means. In order to simplify the construction of such a rivet setting device, the drive motor, the crank drive and the rivet setting means are in permanent operative communication according to the invention and a control means is provided for deactivating the drive motor when the crank drive is in its rest position after the rivet setting operation has been carried out.

23 Claims, 2 Drawing Sheets

RIVET SETTING DEVICE

BACKGROUND OF THE INVENTION

The present invention relates to a rivet setting device.

Such a rivet setting device is e.g. known from U.S. Pat. No. 3,375,883. In this rivet setting device, the electric drive motor is in continuous operation during use of the rivet setting device. The electric drive motor is connected to the crank drive via a coupling mechanism, so that a rivet setting operation can be carried out. After the rivet setting operation has been carried out, the electric drive motor and the rivet setting means are decoupled from one another. However, it has been found that the manufacture of such a rivet setting device is expensive because of the complicated coupling mechanism. Moreover, on account of the weight of the complicated coupling mechanism, the rivet setting device is difficult to handle. Since the electric drive motor is constantly running during use of the rivet setting device, the power consumption is very high. Therefore, such a rivet setting device is not suited for storage battery operation in the case of which the power consumption should be as low as possible.

SUMMARY OF THE INVENTION

Therefore, it is the object of the present invention to develop a rivet setting device of the above-mentioned type in such a manner that its manipulation can be simplified, the production costs can be reduced, and the power consumption decreased.

According to the invention, this object is achieved in that the drive motor, the crank drive and the rivet setting means are in permanent operative communication and that a control means is provided for deactivating the drive motor whenever the crank drive is in its rest position after the rivet setting operation has been carried out.

Such a solution is simple and has the advantage that expensive coupling mechanisms, as are required in the prior art, are no longer needed. The rivet setting device according to the invention can thereby be realized in a considerably easier manner. Since the drive motor is deactivated after a rivet setting operation has been carried out, the power consumption can be reduced considerably. As a result, such a rivet setting device is particularly suited for storage battery operation. The production costs can be reduced considerably due to the reduced number of components.

In an advantageous development, the crank drive can assume its rest position in its front dead-center position facing the rivet setting means. The force/displacement ratios produced by the crank drive can thus be realized in a particularly advantageous manner.

In an alternative embodiment, the crank drive can assume its rest position in its rear dead-center position. It is thus possible to start the drive motor without a pulling force having to be immediately applied to the rivet setting means.

Moreover, it may turn out to be advantageous when there is provided a flywheel which is operatively connected to the drive motor. Such a flywheel is particularly advantageous in an embodiment in which the crank drive assumes its rest position in its rear dead-center position. The drive motor can then first rotate the flywheel before a pulling force has to be applied to the rivet setting means.

In an advantageous development, the flywheel can be coupled with and decoupled from the motor. When the motor is at a standstill, the flywheel can be decoupled, thereby maintaining its flywheel energy, and can again be operatively connected to the drive motor by way of coupling for performing the next rivet setting operation, so that the energy of the flywheel can be used for performing the rivet setting operation. As a result, the power consumption of the rivet setting device can be considerably reduced, in particular in case of a permanent use. To this end, an electromagnetic friction clutch may, e.g., be provided between flywheel and drive motor.

It may be another advantage when the crank drive is positioned in its front dead-center position when the setting stroke of the setting means starts. While the crank drive is moving from its rear dead-center position to its front dead-center position, the drive motor and the flywheel can be rotated to perform the rivet setting stroke with impetus. Power consumption can thereby be reduced as well.

It may be another advantage when a sensing means is provided for sensing an angular position of the crank drive to determine whether the crank drive is in its rest position. Such a configuration can be implemented in a particularly simple manner in the control means. The sensing means can, e.g., be a light barrier or a proximity switch.

In an advantageous development of the invention, the sensing means may comprise a mechanical switch which cooperates with the control means of the crank drive. Moreover, it may be of advantage when the rivet setting device comprises at least one preferably rechargeable battery. The rivet setting device will then be independent of the electric network.

The invention shall now be described in more detail with reference to an embodiment.

DETAILED DESCRIPTION OF THE DRAWINGS

Figure 1:
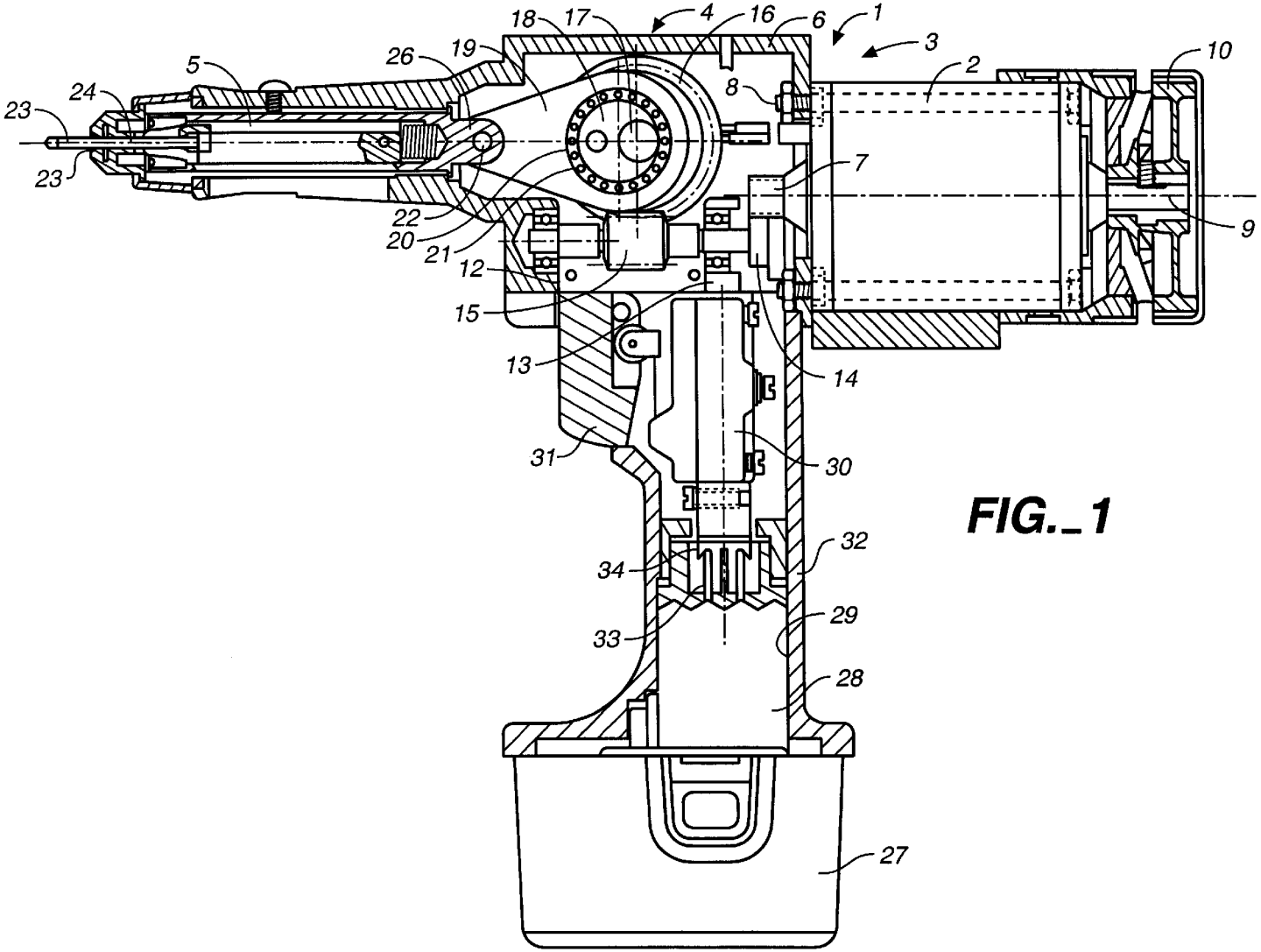
FIG. 1 is a sectional view of a rivet setting device according to the invention.

FIG. 1 is a sectional view of the rivet setting device 1 according to the invention. The rivet setting device 1 comprises an electric motor 2, a transmission 3, a crank drive 4 and a rivet setting means 5. The electric motor 2, the transmission 3, the crank drive 4 and the rivet setting means 5 are arranged in a housing 6 of the rivet setting device 1.

The electric motor 2 is an electric motor which comprises a drive pinion 7 at the side facing the crank drive 4. The electric motor 2 is secured to the housing 6 via a screw union 8. The drive pinion 7 is secured to the motor shaft 9 of the electric motor for rotation therewith, the motor shaft 9 being extended from the electric motor 2 at the side of the electric motor which faces the crank drive. At the side of the electric motor 2 which faces away from the crank drive, a flywheel 10 is mounted on the motor shaft 9 for rotation therewith.

The transmission 3 consists of a transmission shaft 11 which is rotatably supported in the housing 6 at two bearing points 12 and 13. The bearing points 12 and 13 are each provided with ball bearings. The transmission shaft 11 has provided thereon a toothed gear 14 for rotation therewith, said toothed gear 14 meshing with the drive pinion 7, as well as a worm wheel 15. The worm wheel 15 meshes in a toothed gear 16 of the crank drive 4. The crank drive 4 is formed by the toothed gear 16 which is rotatably supported on a shaft 17 which, in turn, is supported in the housing 6. As becomes apparent from FIG. 1, the toothed gear 16 comprises an eccentric 18 which has rotatably supported thereon a connecting rod 19. A ball bearing 21 is positioned between eccentric 18 and an opening 20 in the connecting rod 19. The connecting rod 19 comprises a pin 22 which is hingedly connected to the rivet setting means 5. When the rotational axes of the shaft 17, the eccentric 18 and the pin 22 are arranged in one line, the crank drive is in one of its dead-center positions. When the eccentric 18 is arranged between the shaft 17 and the pin 22, the crank drive is in its front dead-center position; when the shaft 17 is arranged between eccentric 18 and pin 22, the crank drive is in its rear dead-center position.

The rivet setting means is known from the prior art. The front end of the rivet setting means has provided thereon an opening 23 into which a blind rivet 24 with a rivet pin 25 can be inserted in the known manner. Since the function of such a rivet setting means is generally known, the means is only shown schematically. In principle, a setting operation is carried out in that a linear movement of a pulling means 26 of the rivet setting means is performed towards the crank drive. This pulling movement is normally designated as a setting stroke. The rivet setting means is configured such that, upon a movement of the crank drive from its rear dead-center position to its front dead-center position, an idle stroke is carried out and it is only when the crank drive is moving from its front dead-center position to its rear dead-center position that the setting stroke is carried out.

Moreover, the rivet setting device 1 is provided with a battery housing 27 which is removably mounted on the housing 6 and has arranged therein rechargeable batteries. The battery housing 27 comprises a pin-like projection 28 which is received in a receiving means 29 of the housing, as shown in FIG. 1.

A switch 30 which is operable by an actuating means 31 is located inside the housing 6. This actuating means 31 is an ordinary push button which operates the switch 30 by being pressed down.

The housing 6 is designed as a handle 32 in the area of the actuating means 31 and between the electric motor 2 and the battery housing 27. The rivet setting device 1 can be held by an operator at the handle 32, with the fingers of the operator's hand operating the actuating means 31.

Contacts 33 which project from the battery housing 27 communicate with contact tongues 34. These contact tongues 34, in turn, communicate with switch 30 and the electric motor 2 via cables (not shown) and with a circuit 45 (also not shown).

Figure 2:
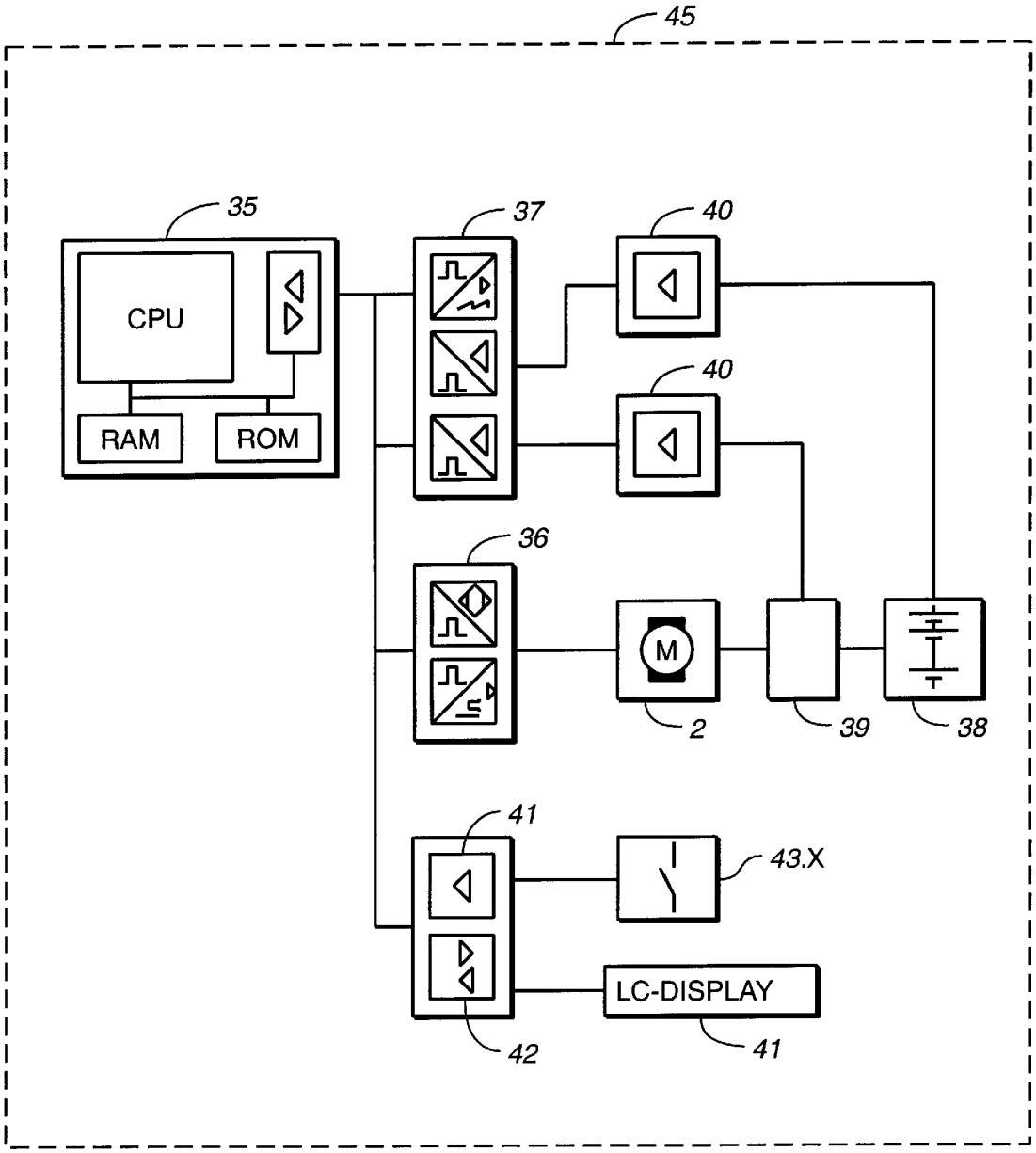
FIG. 2 is a diagrammatic view showing the control means of the rivet setting device of FIG. 1.

The circuit is an electronic circuit, the principle and structure of which are explained in FIG. 2.

A microcontroller 35 comprising CPU, RAM and ROM is used for controlling the rivet setting device. The motor is activated via power MOSFET transistors 46. The motor is stopped at a defined position via proximity switches and transistors. An AD converter 37 which measures the voltage of the rechargeable batteries 38 and, via a sensor 39, the power consumed by the motor, is integrated into the circuit 45.

Measuring amplifiers 40 are respectively provided between the sensor 39 and the AD converter.

If a residual voltage of the rechargeable batteries is not reached, the power supply to the motor is interrupted and the electric motor is stopped in a defined position.

The microcontroller 35 as used is a kind of microprocessor circuit which comprises a CPU, an internal memory (RAM and EPROM) as well as internal drivers.

The external activation of the microcontrol requires the generation of a timing signal and a reset wiring.

The AD converter consists, on the one hand, of a circuit for generating a sawtooth signal and, on the other hand, of a comparator circuit consisting of sawtooth signal and the output of the measuring amplifiers.

The measuring amplifiers adapted the measurement signal to the level of the sawtooth signal of the AD converter. The voltage of the rechargeable batteries is adjusted with the measuring amplifiers which are assigned to the rechargeable batteries, and further data, such as motor current, force applied to the rivet setting means, etc., can be collected with the measuring amplifiers which are assigned to the MS sensor. The voltage of the rechargeable batteries must be evaluated to prevent any starting of the rivet setting device when the residual capacity is too small. This prevents a blocking of the rivet setting device. When the residual voltage is achieved, the motor is stopped in a defined position.

The motor is controlled via the power MOSFET transistor. The motor current in the start phase of the motor is limited via said transistor. When a small motor output is required for an application, the power consumption of the motor can be reduced through the motor control by means of a pulse-width modulation.

Moreover, a proximity switch (not shown in more detail) is provided for detecting a predetermined position of the crank drive 4. In the present case, this is the position in which the crank drive is in its front dead-center position. In this position, the rotational axes of the toothed gear 16 and the eccentric 18 and the pin 22 are positioned in one line, with the eccentric being displaced towards the rivet setting means. Such a control makes is possible to stop the motor in a purposeful manner whenever the crank drive 4 is in its front dead-center position.

Moreover, there are provided drives 41 and 42 which communicate with the microcontroller and the keys 43.X and a display means 44. The rivet setting device can be put into and out of operation by means of a key 43.0. The display means 44 can be used for displaying the charge state of the rechargeable batteries. Moreover, it is possible to regulate the maximum power consumption of the motor with the help of these keys 43.X. To this end, a value which is typical of the maximum power consumption of the electric motor 2 can be displayed in the display means. This value can be decreased or increased by keys 43.X. This value can, e.g., be gathered from a table in which the maximum power consumption is compared with the size of the rivet to be processed. Such a table can also be integrated into the rivet setting device and, e.g., be stored in the microcontroller 35. It is then possible to display, e.g., the diameter of the rivet pin of the rivet to be processed in the display means. The value of the diameter of the rivet pin can be increased or decreased accordingly by operating keys 43.X, so that the rivet setting device is set accordingly and the maximum power consumption is limited correspondingly.

The operation and function of the invention shall now be explained in more detail:

An operator who intends to set rivets with the rivet setting device 1 according to the invention will first mount the battery housing 27 in the known manner on the rivet setting device 1, together with the charged and rechargeable batteries arranged in the housing. To this end, the battery housing 27 is inserted with its projection 28 into the receiving means 29 of the rivet setting device 1, with the contacts 33 getting into engagement with the contact tongues 34, whereby power can be supplied to the circuit 45. The operator will then grip with his hand the rivet setting device 1 at handle 32, with one finger of his hand being able to operate the actuating means 31 in a known manner. A blind rivet 24 is subsequently inserted with its rivet pin 25 into the rivet setting means in the known manner.

When the operator presses the actuating means 31 into the housing 6, switch 30 will be operated. Power is thereby supplied to the electric motor 2 via circuit 45. The electric motor which is acted upon by current now transmits its torque via the toothed gear 14 to the transmission shaft 11 and thus to the worm wheel 15 at the same time. The worm wheel meshes in a toothed gear 16 and rotates the eccentric 18. In the initial position of the rivet setting device 1, the rotational axes of shaft 17, eccentric 18 and pin 22 are located along one line, with the crank drive being in its rear dead-center position.

Upon actuation of the drive motor with current, said motor starts so that the crank drive moves from its rear dead-center position to its front dead-center position. Since the rivet setting means is designed such that it performs an idle stroke during this initial movement of the crank drive, the drive motor can start without any problems and can be rotated without the same being already acted upon by pulling forces applied by the rivet setting means. As soon as the crank drive has reached its front dead-center position, the drive motor starts to apply a pulling force to the pulling means 26 of the rivet setting means 5 via the crank drive 4. A rivet setting operation is now performed in the known manner due to this pulling force. The rivet setting operation will be terminated when the crank drive is again in its rear dead-center position, i.e., its initial position. FIG. 1 shows the rivet setting device when the crank shaft is in its front dead-center position, i.e., at the beginning of the setting stroke.

A sensor (not shown) senses the initial position, i.e., when the crank drive is in its rear dead-center position and automatically interrupts the power supply when the actuating means is no longer actuated, so that the crank drive is stopped in its rear dead-center position.

A particularly great torque or a particularly great pulling force can be applied, in particular, at the beginning of the setting stroke, through the flywheel which is connected to the drive motor. At the beginning of the rivet setting operation, the force is maximum. Due to the idle stroke during displacement from the rear dead-center position to the front dead-center position, the flywheel can be rotated accordingly. In an alternative embodiment, the rotating flywheel can additionally be connected to the drive motor via an electromagnetic coupling means (not shown). The coupling means can be controlled such that the rotating flywheel is activated at the beginning of a rivet setting operation. As a result, the motor is rotated more rapidly. In addition, the flywheel energy of the flywheel can be used at a delay to overcome the forces prevailing at the beginning of the rivet setting stroke. As soon as the crank drive is in its rear dead-center position, the flywheel can be decoupled again and further rotate independently of the electric motor. The flywheel energy can thereby be stored. This is particularly advantageous during continuous operation of the rivet setting device, because the flywheel can support the start of the motor and the application of the rivet forces. The power consumption can thus be reduced considerably.

Due to the fact that the rivet setting device is stopped in the defined position and is operated from said position, the force conditions during use of the crank drive 4 are particularly advantageous. Since the initial position is electronically sensed, no expensive coupling mechanisms are needed in comparison with conventional solutions. The electric motor 2 can be in permanent engagement with the crank drive 4 and the transmission 3.

The circuit 45 additionally ensures that, prior to the performance of any rivet setting operation, the instantaneous voltage of the rechargeable batteries is first compared with a predetermined minimum value. As long as the voltage of the rechargeable batteries is above said minimum value, it is still possible to carry out a complete rivet setting operation. Should the voltage of the rechargeable batteries fall below said predetermined value, no further rivet setting operation will be carried out. This has the advantage that the voltage of the rechargeable batteries will not break down during a rivet setting operation and that the rivet setting device will not be blocked thereby. Such constant comparing and monitoring operations for the voltage of the rechargeable batteries are carried out automatically by the circuit 45. The capacity of the rechargeable batteries can thus be used in an optimum manner without the risk that the rivet setting device will be blocked during a rivet setting operation due to insufficient voltage.

Moreover, it is possible through the keys 43.X to limit the maximum power consumption, depending on the respective use of the rivet setting device 1. To this end, a value which is typical of the specific application is indicated in the display means 44, which may, e.g., be an LCD display; this value can, e.g., be the diameter of the rivet pin 25. In cases where blind rivets are to be processed at a predetermined rivet pin diameter, the key 43.2 and the key 43.3, respectively, will be operated until the corresponding value is displayed in the display means 44; key 43.2, for example, can be used for increasing the display value in the display means 44, i.e., when larger diameters are to be processed, and key 43.3 can be used for decreasing the display value. The diameter sizes of the rivet pins are displayed step by step. For instance, the next-greater rivet pin diameter can be displayed by pressing key 43.2 once. Likewise, the next-lower display value or rivet pin diameter can be displayed by pressing key 43.3.

Moreover, during operation of the rivet setting device 1, the instantaneous charge state of the rechargeable batteries can be read with the help of the display means 44.

It is to be understood that while the invention has been described above in conjunction with preferred specific embodiments, the description and examples are intended to illustrate and not limit the scope of the invention, which is defined by the scope of the appended claims.

What is claimed is:

1. A rivet setting device comprising:

an electric drive motor, a rivet setting means, a crank drive for driving said rivet setting means via said drive motor, wherein said crank drive assumes a rest position and, starting from the rest position, can be rotated by at least one complete rotation for performing a rivet setting operation of said rivet setting means, characterized in that said drive motor, said crank drive and said rivet setting means are in permanent operative communication, and a control means for automatically deactivating said drive motor when said crank drive is in the rest position after the rivet setting operation has been performed.

2. The rivet setting device according to claim 1, wherein the rest position is either a front dead-center position facing said rivet setting means or a rear dead-center position.

3. The rivet setting device according to claim 1, wherein a flywheel is provided which is operatively connected to said drive motor.

4. The rivet setting device according to claim 3, wherein said flywheel can be coupled with and decoupled from said drive motor.

5. The rivet setting device according to claim 1, wherein the rest position is a front dead-center position when a setting stroke of said rivet setting means starts.

6. The rivet setting device according to claim 1, wherein a sensing means is provided for sensing an angular position of said crank drive so as to determine whether said crank drive is in the rest position.

7. The rivet setting device according to claim 6, wherein said sensing means comprises a mechanical switch which cooperates with the control means of said crank drive.

8. The rivet setting device according to claim 1, wherein said rivet setting device comprises at least one rechargeable battery.

9. A rivet setting device comprising:

an electric drive motor, a rivet setting means, a crank drive for driving said rivet setting means via said drive motor, wherein said crank drive assumes a rest position and, starting from the rest position, can be rotated by at least one complete rotation for performing a rivet setting operation of said rivet setting means, characterized in that said drive motor, said crank drive and said rivet setting means are in permanent operative communication, and further wherein the rest position is either a front dead-center position facing said rivet setting means or a rear dead-center position, a control means for deactivating said drive motor when said crank drive is in the rest position after the rivet setting operation has been performed, a flywheel operatively connected to said drive motor, wherein said flywheel can be coupled with and decoupled from said drive motor, and further wherein the rest position is the front dead-center position when the setting stroke of said rivet setting means starts, a sensing means for sensing an angular position of said crank drive so as to determine whether said crank drive is in its rest position, wherein said sensing means comprises a mechanical switch which cooperates with the control means of said crank drive, and at least one rechargeable battery.

10. A rivet setting device comprising:

an electric drive motor, a rivet setting means, a crank drive for driving said rivet setting means via said drive motor, wherein said crank drive assumes a rest position and, starting from the rest position, can be rotated by at least one complete rotation for performing a rivet setting operation of said rivet setting means, characterized in that said drive motor, said crank drive and said rivet setting means are in permanent operative communication, and further wherein the rest position is either a front dead-center position facing said rivet setting means or a rear dead-center position, a control means for deactivating said drive motor when said crank drive is in the rest position after the rivet setting operation has been performed, and a flywheel operatively connected to said drive motor, wherein said flywheel can be coupled with and decoupled from said drive motor.

11. The rivet setting device according to claim 10, wherein the rest position is the front dead-center position when a setting stroke of said rivet setting means starts.

12. The rivet setting device according to claim 10, wherein a sensing means is provided for sensing an angular position of said crank drive so as to determine whether said crank drive is in the rest position.

13. The rivet setting device according to claim 12, wherein said sensing means comprises a mechanical switch which cooperates with the control means of said crank drive.

14. The rivet setting device according to claim 10, wherein said rivet setting device comprises at least one rechargeable battery.

15. The rivet setting device according to claim 10, wherein the control means automatically deactivates said drive motor when said crank drive is in the rest position after the rivet setting operation has been performed.

16. A rivet setting device comprising:

an electric drive motor, a rivet setting means, a crank drive for driving said rivet setting means via said drive motor, wherein said crank drive assumes a rest position and, starting from the rest position, can be rotated by at least one complete rotation for performing a rivet setting operation of said rivet setting means, characterized in that said drive motor, said crank drive and said rivet setting means are in permanent operative communication, a control means for deactivating said drive motor when said crank drive is in the rest position after the rivet setting operation has been performed, and a sensing means for sensing an angular position of said crank drive so as to determine whether said crank drive is in the rest position.

17. The rivet setting device according to claim 16, wherein the rest position is either a front dead-center position facing said rivet setting means or a rear dead-center position.

18. The rivet setting device according to claim 16, wherein a flywheel is provided which is operatively connected to said drive motor.

19. The rivet setting device according to claim 18, wherein said flywheel can be coupled with and decoupled from said drive motor.

20. The rivet setting device according to claim 17, wherein the rest position is the front dead-center position when a setting stroke of said rivet setting means starts.

21. The rivet setting device according to claim 16, wherein said sensing means comprises a mechanical switch which cooperates with the control means of said crank drive.

22. The rivet setting device according to claim 16, wherein said rivet setting device comprises at least one rechargeable battery.

23. The rivet setting device according to claim 16, wherein the control means automatically deactivates said drive motor when said crank drive is in the rest position after the rivet setting operation has been performed.

* * * * *